US005775015A

United States Patent [19]

Hourihan

[11] Patent Number: 5,775,015

[45] Date of Patent: Jul. 7, 1998

[54] LOCATION RECORDER PROCESS AND ASSEMBLY

[76] Inventor: Gweneth H. Hourihan, 2350 Lake View Ave., Los Angeles, Calif. 90039

[21] Appl. No.: 547,655

[22] Filed: Oct. 24, 1995

[51] Int. Cl.[6] ..... G09F 11/04

[52] U.S. Cl. ..... 40/495; 434/206; 434/215

[58] Field of Search ..... 40/495; 434/206, 434/215

[56] References Cited

U.S. PATENT DOCUMENTS

| | | | |
|---|---|---|---|
| 134,257 | 12/1872 | Cottle | 40/495 X |
| 203,988 | 5/1878 | Bailey | 40/495 X |
| 521,983 | 6/1894 | Lawrence et al. | 40/495 |
| 602,918 | 4/1898 | Sebastian | 40/495 X |
| 924,058 | 6/1909 | Graves | 40/495 X |
| 1,016,575 | 2/1912 | Meinhardt | 40/495 X |
| 1,075,256 | 10/1913 | Hutchison | 40/495 |
| 1,555,575 | 9/1925 | Hogsten et al. | 40/495 X |

*Primary Examiner*—Kenneth J. Dorner
*Assistant Examiner*—Andrea Chop

[57] ABSTRACT

The location recorder assembly consists of a pair of disks, each bearing location site information about their periphery. The disks are held together by a pair of indicator studs, the heads of which are independently rotatable and which bear designation devices to permit a particular location site to be designated by the rotational orientations of the disks and the indicator studs.

7 Claims, 1 Drawing Sheet

LOCATION RECORDER PROCESS AND ASSEMBLY

The present invention relates to a location recorder process and assembly, particularly a small, simple assembly suitable for carrying on a key chain, to record the location of an article, such as an automobile.

Various situations require a location to be remembered. For example, large shopping centers often provide acres of surrounding parking. When leaving a car at a parking spot provided in such a facility, it is necessary to remember accurately the location so that the car may be found when the motorist returns. Similarly, large parking structures, such as those at airports, require the traveler to recall, even weeks later, the location of the parked vehicle.

To assist the vehicle owner in such situations, often parking structures divide the total parking area into sections, or floors, and subdivide each section into regions or zones. Floors or sections typically are numbered, while regions or zones often bear a letter, and subregions or sub-zones a number. Thus, a vehicle might have been left on the sixth floor of a parking structure in Zone K, sub-zone 7.

It is of course possible to write down the location of a parked vehicle. But this requires writing materials and that the note be kept, often for days or weeks, and then relocated in order to find the vehicle. Often locating the note is as difficult as finding the car.

It would be desirable to have a small, simple yet effective device to permit location to be easily recorded. Preferably the device should be inexpensive and easily found to permit the vehicle's location to be recalled. These and other objects of the invention will be apparent from the following description of the preferred embodiment.

BRIEF SUMMARY OF THE INVENTION

The invention provides a location recorder process and assembly, the assembly being of a size and construction that, in a preferred embodiment, may be held on a key chain and carried in a pocket or purse. Thus, to record and recall a location, all the user need do is use the the assembly at hand on the key chain, attached to the ignition key.

The location recorder assembly preferably consists of a series of disks bearing about its periphery various location site indicia. The disks include a central aperture in which is received an indicator stud. The indicator stud bears a designation device and is rotatable relative to the disk to permit the designation device to be turned to indicate a particular location site on the periphery of the disk. Also, means are included to hold the indicator stud in any selected rotational orientation relative to disk's indicia.

The location recorder assembly may include indicia on one face of the disk, or may have indicia on both faces of the disk. When indicia are provided on both faces of the disk, preferably a pair of independent indicator studs are provided, one for each side of the disk. Also, means are provided to attach the location recorder assembly to key holder. Further, a second disk also bearing location site indicia may be provided that is smaller than the first disk, the second disk also bearing a designation device as well as location site indicia to permit it to be used to designate a location site on the first disk while the indicator stud is used to designate a location site on the second disk. Each disk and stud may have teeth on its side in order to facilitate its manual rotation.

BRIEF DESCRIPTION OF THE DRAWING

The invention will be further described in connection with the accompanying drawings, in which.

DETAILED DESCRIPTION

Figure 1:
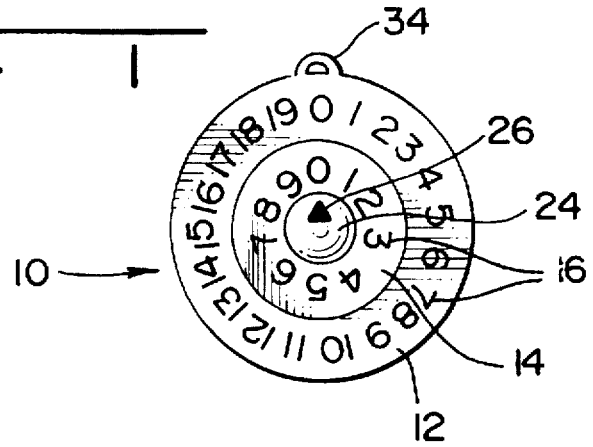
FIG. 1 is a plan view of the obverse side of the location recorder assembly.

The location recorder assembly, in a preferred embodiment such as shown in the drawings, consists of two disks held to one another by a particular construction and assemblage of two studs. This construction is simple and inexpensive; it lends itself to volume production of an article that may be given away as a promotional device if desired, and conveniently carried by the user attached to the key chain bearing the ignition key for the vehicle to be located.

More particularly, the location recorder assembly 10 consists of a first disk 12 and a second disk 14. Both the first disk 12 and the second disk 14 bear location site indicia 16 about their periphery. Such indicia may be a series of numbers, as shown, or a combination of numbers and letters, or colored zones, or most any other sort of indicia appropriate to the location area or areas for which the location recorder assembly is commonly used. Thus, if the assembly is to be distributed by a large shopping mall to its patrons, for example, the indicia would be appropriate to the designations used in the mall's parking area.

Figure 2:
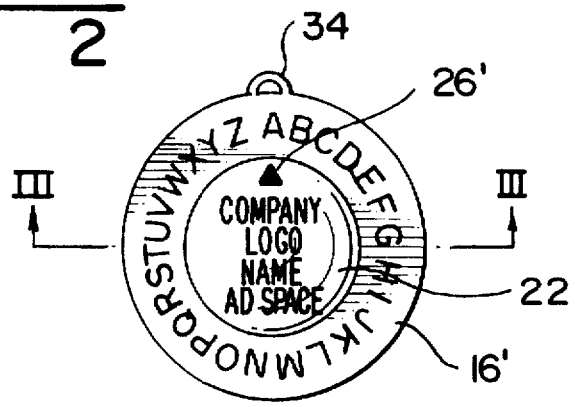
FIG. 2 is a plan view of the reverse side of the location recorder assembly.

As shown in FIG. 2, the reverse side of the first disk may also contain on its peripheral face portion, a collection of indicia 16'.

Figure 3:
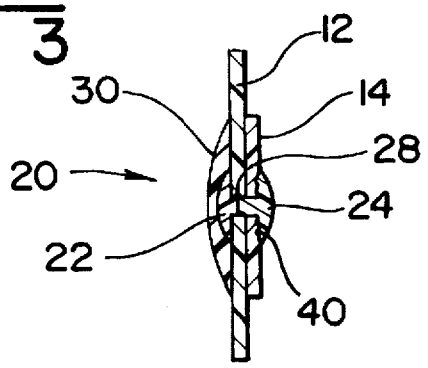
FIG. 3 is a cross-sectional view taken on lines III—III of FIG. 2.

The first and second disks preferably are held to one another by an indicator stud assembly best shown in FIG. 3. This stud assembly 20 consists of a first or larger stud 22 on the reverse side of the location recorder assembly, and a second or small stud 24 on the obverse of the location recorder assembly. Each stud includes a designation device 26, such as an arrowhead, on its periphery.

Each of the disks 12 and 14 includes a central aperture 28 that is large enough to receive the shafts of studs 22 and 24. In a preferred construction, the shaft of stud 24 bears external threads and is of a size appropriate to be received in the internally-threaded shaft of stud 22, the two studs coming together as their shafts screw down on one another. The threads of the shafts may be coated with a locking material, if desired, to hold the studs in a fixed longitudinal orientation relative to one another. To permit the designation device carried on each stud to be rotated independent of one another, preferably indicator stud 22 includes an outer sleeve, or cap, 30, about its head that may rotate relative to the head. This cap may bear advertising or other information on its outer surface if desired.

Preferably the indicator studs are screwed together tight enough to hold the two disks relative to one another and the rotational orientation of the heads of the indicator studs relative to one another and to the disks such that the rotational orientation may not be easily displaced. This may be achieved simply through frictional forces, if desired, or ridges or bumps 40 may be provided on the surfaces of the assembly that bear against one another to enhance the tendency of the elements to remain in a given rotational orientation.

Preferably the first disk includes a second aperture 34 of a size sufficient to receive a key chain or a split ring, thereby to permit it to be attached to and associated with the ignition key of a particular car.

One preferred embodiment of the invention has been shown and described. Those of ordinary skill in this field will recognize that various changes may be made in the elements of the assembly and their construction. Thus, the invention is not limited to the particular construction shown, but rather is as set forth in the following claims.

I claim:

1. A location recorder assembly including:

a first disk having two faces, a first face and a second face, each face bearing location site indicia about its periphery, the first disk including a central aperture, a second disk having a face bearing location site indicia about the periphery, the second disk being smaller than the first disk to expose the location site indicia about the periphery of the first disk, the second disk also including a central aperture, a first indicator stud bearing a designation device and mounted in the apertures, of the first and second disks, the stud being rotatable relative to the disks to permit the designation device to be turned to indicate a particular location site on the periphery of the first face of the first disk;

a second indicator stud bearing a designation device and mounted in the aperture of the first and second disks, the second indicator stud being rotatable independent of the first indicator stud to indicate a particular location on the second face of the first disk; and means to hold the first and second indicator studs in any selected rotational orientation relative to the disks' indicia.

2. A location recorder assembly as set forth in claim 1 including means to attach the assembly to a key holder.

3. A location recorder assembly as set forth in claim 1 in which the second indicator stud includes a cap rotatably attached to the second indicator stud.

4. A location recorder assembly as set forth in claim 3 in which the cap is circular and of a size to expose the location site indicia about the periphery of the first disk.

5. A location recorder assembly as set forth in claim 3 in which the cap is of a size adequate to bear advertising indicia thereon.

6. A location recorder assembly as set forth in claim 1 including means to enhance the tendency of the disks and studs to remain in a given rotational orientation.

7. A location recorder assembly as set forth in claim 6 in which the enhancement means includes cooperating ridges or bumps on the disks and studs.

* * * * *